US008261417B2

(12) United States Patent
Yoshiguchi

(10) Patent No.: US 8,261,417 B2
(45) Date of Patent: Sep. 11, 2012

(54) BUCKLE

(75) Inventor: Manabu Yoshiguchi, Kamakura (JP)

(73) Assignee: Nifco Inc., Yokohama-Shi (JP)

( * ) Notice: Subject to any disclaimer, the term of this patent is extended or adjusted under 35 U.S.C. 154(b) by 228 days.

(21) Appl. No.: 12/453,854

(22) Filed: May 26, 2009

(65) Prior Publication Data

US 2009/0293243 A1 Dec. 3, 2009

(30) Foreign Application Priority Data

May 28, 2008 (JP) ..... 2008-139428

(51) Int. Cl.
*A44B 11/25* (2006.01)

(52) U.S. Cl. ..... 24/633; 24/629; 24/662; 24/664; 24/665; 24/671; 24/578.11; 24/578.15; 24/578.1; 24/579.09; 24/589.1; 24/591.1

(58) Field of Classification Search ..... 24/629, 24/633, 662, 664, 665, 671, 578.15, 578.11, 24/578.1, 579.09, 589.1, 591.1
See application file for complete search history.

(56) References Cited

U.S. PATENT DOCUMENTS

| | | | | |
|---|---|---|---|---|
| 4,282,634 | A * | 8/1981 | Krauss | 24/323 |
| 4,425,689 | A * | 1/1984 | Fildan | 24/664 |
| 4,928,364 | A * | 5/1990 | Ikeda | 24/614 |
| 4,945,614 | A * | 8/1990 | Kasai | 24/579.09 |
| 5,309,610 | A * | 5/1994 | le Gal | 24/625 |
| 5,440,792 | A * | 8/1995 | Ida | 24/615 |
| 5,551,131 | A * | 9/1996 | Anscher | 24/614 |
| 5,855,057 | A * | 1/1999 | Anscher | 24/614 |
| 6,000,109 | A * | 12/1999 | Anscher | 24/614 |
| 2006/0080811 | A1 * | 4/2006 | Grimm | 24/615 |

FOREIGN PATENT DOCUMENTS

| | | | |
|---|---|---|---|
| JP | H02-033613 | U | 3/1990 |
| JP | H08-052009 | A | 2/1996 |
| JP | 2000-116413 | A | 4/2000 |
| JP | 2004-052454 | | 2/2004 |
| JP | 2005-58442 | A | 3/2005 |
| JP | 2005-127527 | A | 5/2005 |

* cited by examiner

*Primary Examiner* — Robert J Sandy
*Assistant Examiner* — David Upchurch
(74) *Attorney, Agent, or Firm* — Manabu Kanesaka

(57) ABSTRACT

A buckle includes a male member, a female member for engaging with the male member and having a first portion and a second portion, a first engaging portion provided on the first portion, and a second engaging portion provided on the male member for engaging with the first engaging portion. The second portion can bend so as to receive a part of the male member between the first and second portions. The second portion presses the male member toward the first portion to engage the first engaging portion with the second engaging portion when the male member is inserted between the first and second portions.

1 Claim, 8 Drawing Sheets

BUCKLE

BACKGROUND OF THE INVENTION AND RELATED ART STATEMENT

This invention relates to an improvement of a buckle, comprising a male member and a female member, the buckle engaging a part of the male member with the female member so that both members are engaged. For example, the invention relates to a buckle for connecting a belt-like body attached to the male member and another belt-like body attached to the female member.

A conventional buckle comprises a female buckle member having a flat tube shape and provided with an elastic plate-like part having engaging means on the inside of the leading end on one side of a broad face part by forming a pair of slits-on the face part, and a male buckle member having engaging means corresponding to said engaging means on an insertion part which is inserted into the female buckle member while bending said elastic plate-like part. (See Japanese Unexamined Patent Application Publication No. 2000-116413: Patent Document 1)

However, in such buckle, because one of the engaging means is provided on said elastic plate-like part which bends during the operation of engagement of the female buckle member and the male buckle member, it is necessary to increase the rigidity of this elastic plate-like part in order to make the state of connection of the two secure. However, by doing so, the elastic plate-like part becomes harder to bend during said engagement operation, and it makes this operation difficult to perform. Also, there is a need to form slits on one side of the broad face part of the female buckle member serving as the front/top side of the buckle, and accordingly, it is difficult to secure a space enough to engrave logos, and the like, on the front side of the buckle.

The main problem which this invention attempts to solve is to make the operation of connection of the male member and the female member easy, while making the state of connection after this operation as secure as possible.

Further objects and advantages of the invention will be apparent from the following description of the invention.

SUMMARY OF THE INVENTION

In order to solve the aforementioned problem, in this invention, the buckle comprises a male member, and a female member having a first portion and a second portion so as to receive a part of the male member between the first and second portions from one side by bending the second portion.

Further, there is formed on the first portion an engaging portion for engaging with a corresponding engaging portion formed on the male member by bending back of the second portion at the final position of the engagement.

The engagement of the insertion part as the part of the male member between the first portion and the second portion of the female member is allowed by the bending of the second portion, and the female member and the male member are connected by the engagement of the engaging portion and the corresponding engaging portion by the bending back at the final position of this engagement. If it is made such that during the engagement of the part of the male member into the female member, the second portion of the female member bends gradually by an inclined part formed on either one or both of the male member and the female member, then this engagement can be accomplished smoothly.

Because said engagement is allowed by the bending of the second portion, and the engaging portion is provided to a first portion which does not bend, even when it is constituted so that the second portion is easy to bend so as to reduce the force of insertion necessary for said engagement, the state of connection of the two members is secure and stable regardless of the presence or absence of action of a force in the direction of pulling the male member out from the female member (pulling-out force). From this state of connection, when the first portion is operated toward the direction of separating it from the part of the male member engaged with the female member, because this first portion does not bend as mentioned previously, the second portion is caused to be bent toward the direction of moving away from the first portion via the male member, whereby the space between the first portion and the second portion is widened in the same manner as during said engagement of the part of the male member and the engagement of the engaging portion and the corresponding engaging portion can be released. By this, the connection of the two members can be released. If it is provided on said first portion with an operating part which makes it possible to separate the first portion from the part of the received male member while causing the second portion to bend, then this release can be accomplished easily. If a hole portion is formed on the second portion of said female member, and two sides surrounding this hole portion serve as side base portions of the second portion, then said bending of this second portion can be made easier.

If either one or both of said male member and female member is provided with an attaching part to a belt-like body or a cord-like body, and said engaging portion is positioned on the active central axis of the load applied to said belt-like body or cord-like body during tension, then two belt-like bodies, or the like, can be connected by the buckle, or the ends of one belt-like body, or the like, can be connected together, and the engaging portion can be engaged even more securely with the corresponding engaging portion during such tension.

If there is formed on either one or both of said male member and female member a guide part which is formed along the direction of engagement of a part of the male member and guides the part of the male member during this engagement, then said engaging portion can be engaged assuredly with the corresponding engaging portion by the engagement of the part of the male member into the female member.

In the buckle according to this invention, it can be constituted such that the second portion is easy to bend so that connection of the male member and the female member is easy, while the state of connection can be made as secure as possible. Also, the buckle can be given a nice cosmetic appearance with the first portion as the front side of the buckle. Also, an area for display of logos, and the like, can be sufficiently secured on the front side of the buckle.

DETAILED DESCRIPTION OF PREFERRED EMBODIMENTS

The preferred embodiments of the invention are explained below with reference to FIGS. 1-20.

Figure 1:
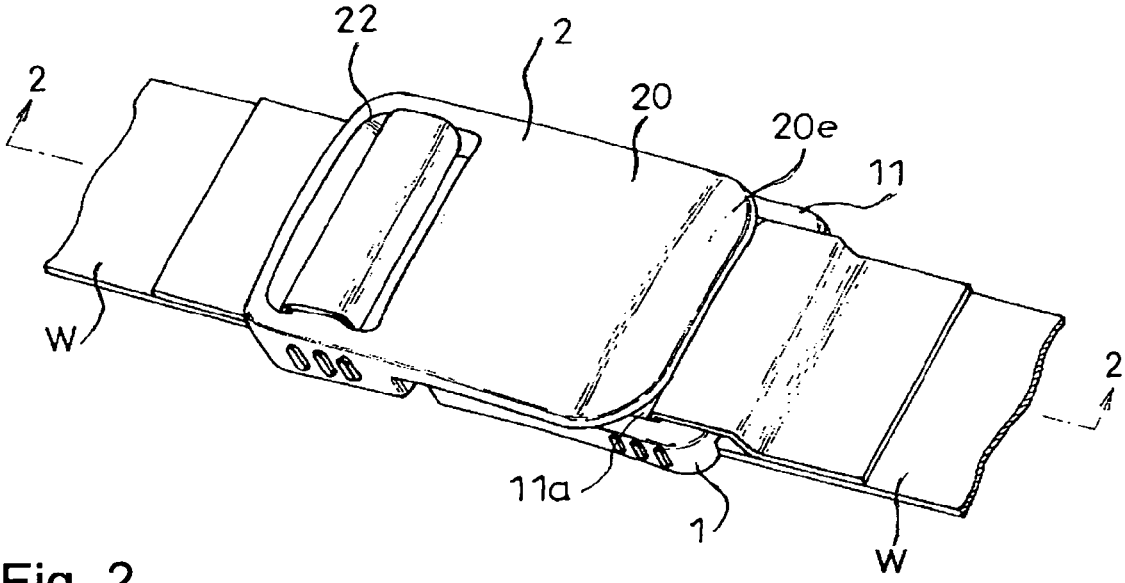
FIG. 1 is a perspective view showing the condition of use of the buckle.
Figure 2:
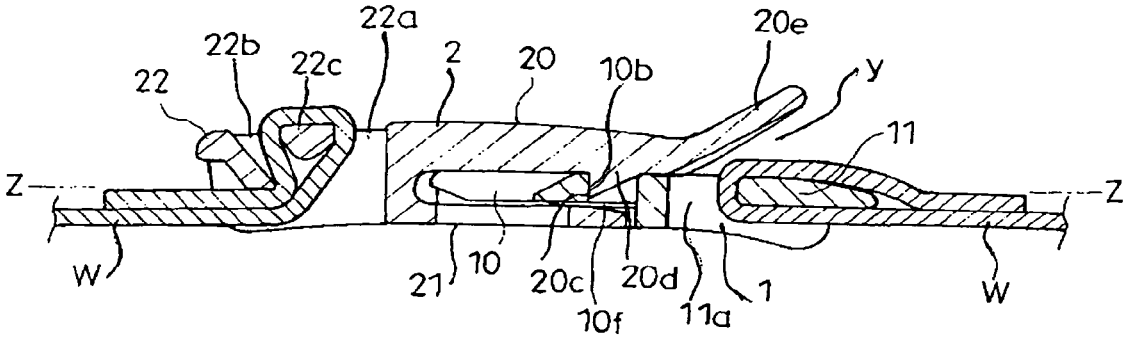
FIG. 2 is a sectional view along the line 2-2 in FIG. 1.
Figure 3:
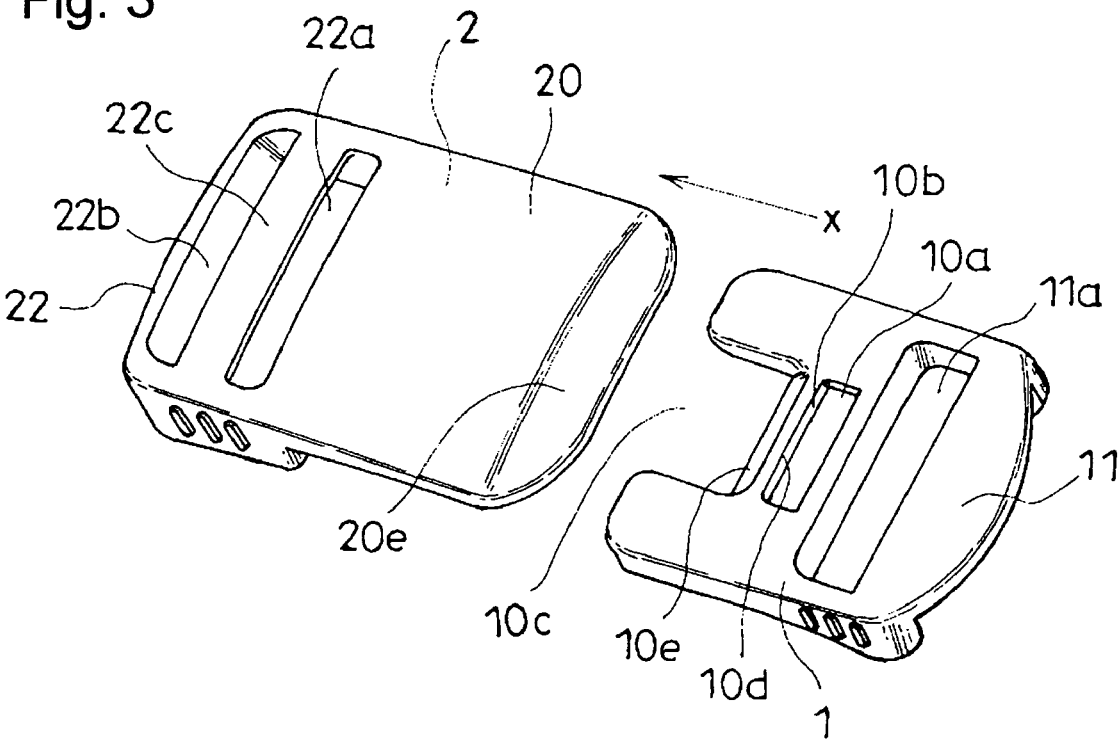
FIG. 3 is a perspective view showing the condition with the female member 2 and the male member 1 separated.
Figure 4:
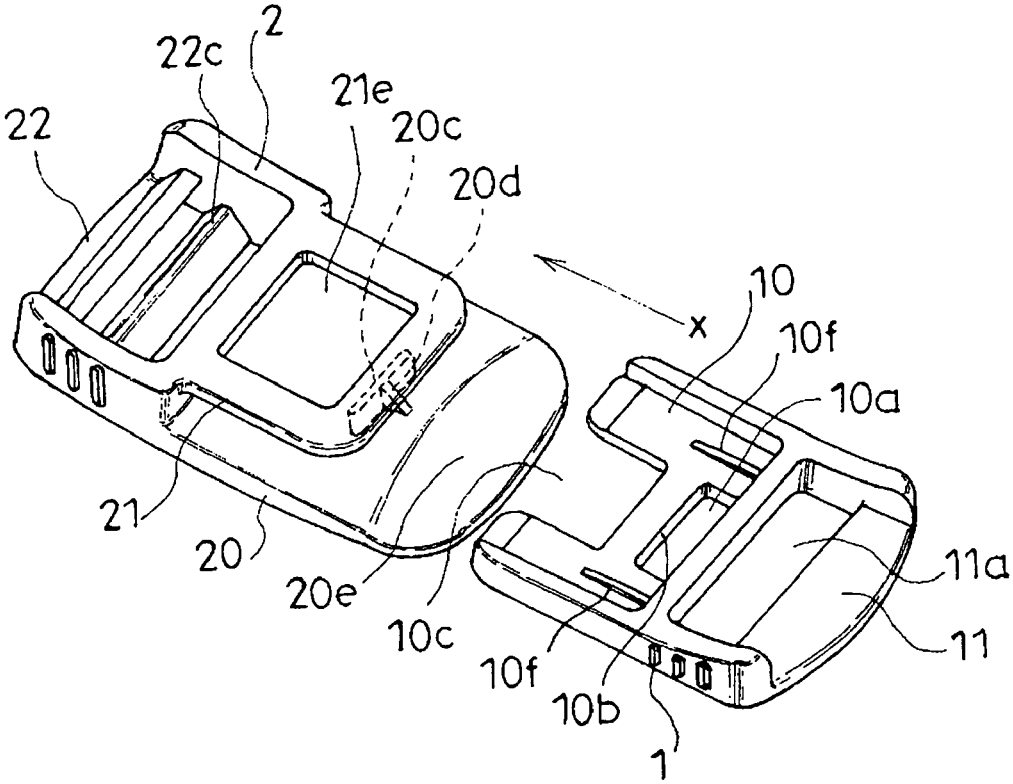
FIG. 4 is a perspective view showing the condition with the female member 2 and the male member 1 separated (view from the down side of FIG. 3).
Figure 5:
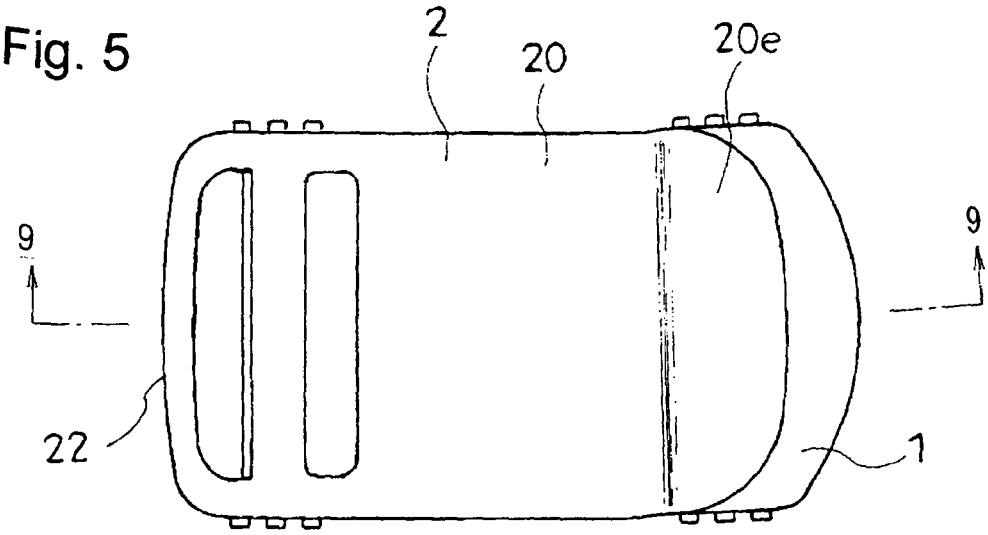
FIG. 5 is a front view of the buckle.
Figure 6:
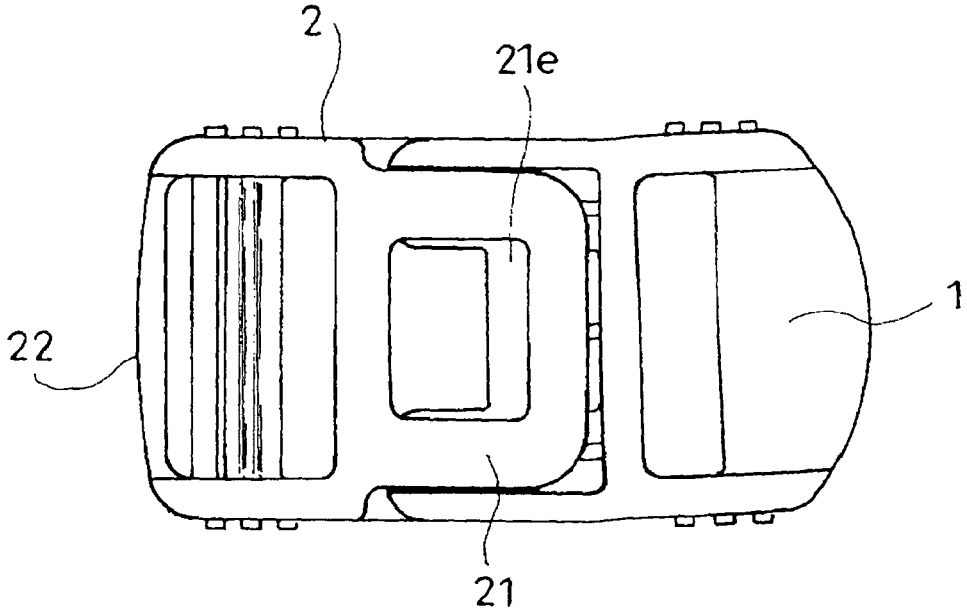
FIG. 6 is a back view of the same.
Figure 7:
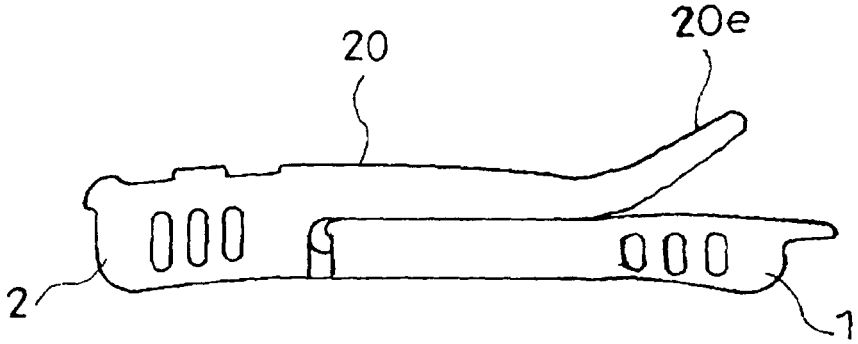
FIG. 7 is a side view of the same.
Figure 8:
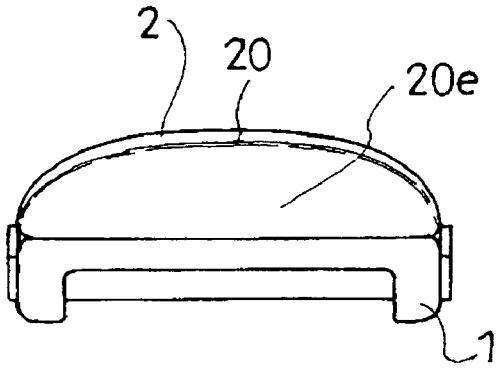
FIG. 8 is a side view of the same (view from the right side of FIG. 7).
Figure 9:
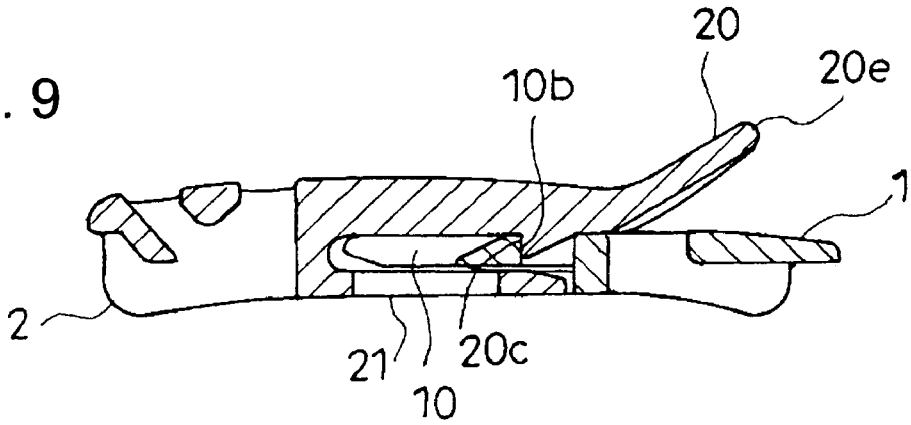
FIG. 9 is a sectional view along the 9-9 line in FIG. 5.
Figure 10:
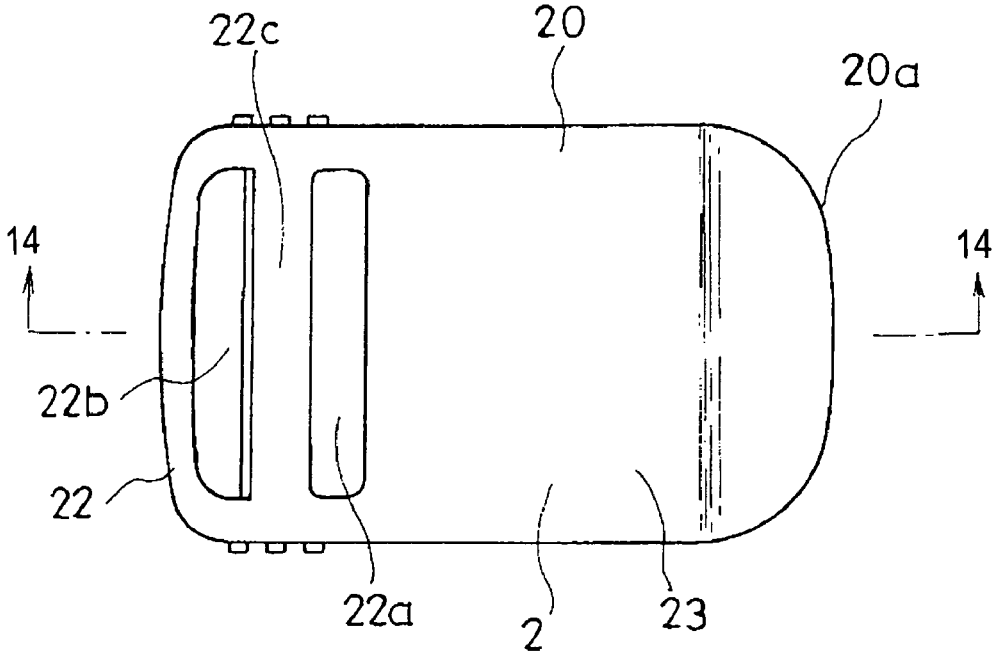
FIG. 10 is a front view of the female member 2.
Figure 11:
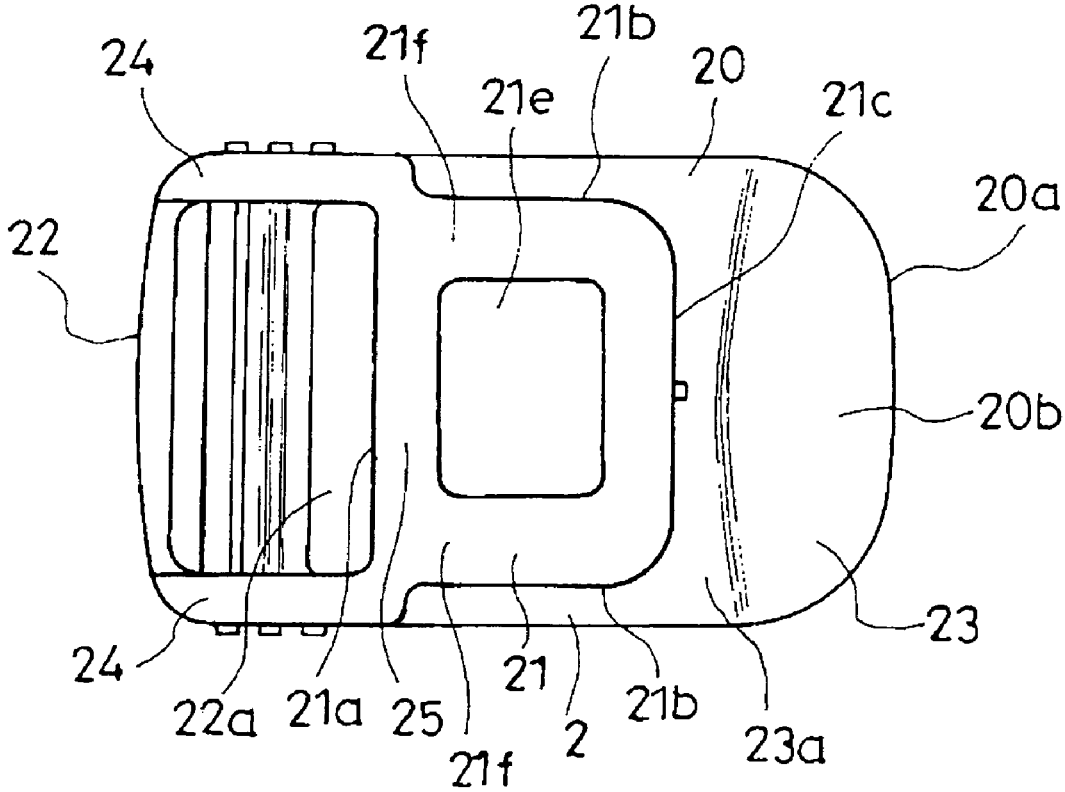
FIG. 11 is a back view of the same.
Figure 12:
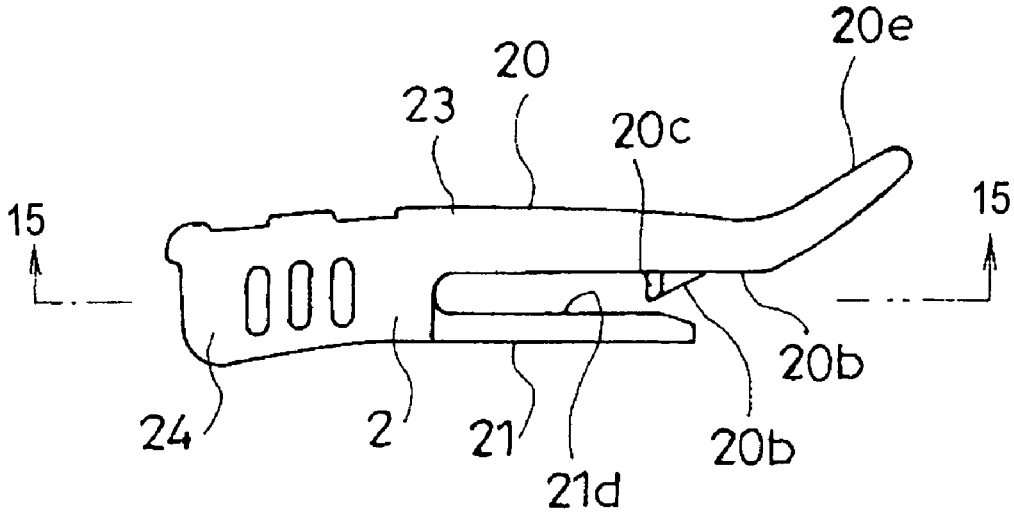
FIG. 12 is a side view of the same.
Figure 13:
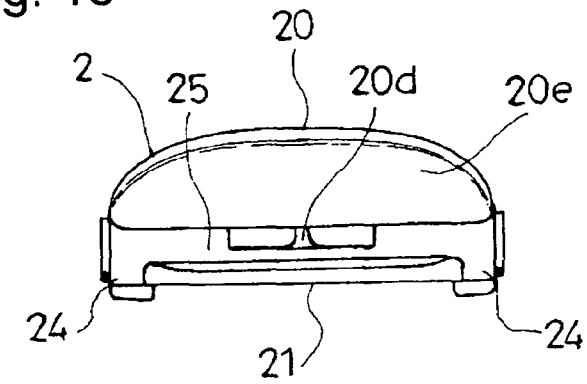
FIG. 13 is a side view of the same (view from the right side of FIG. 12).
Figure 14:
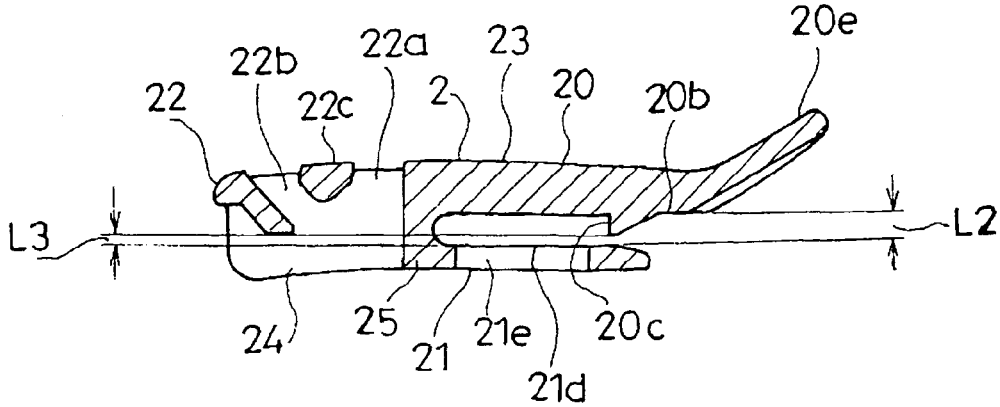
FIG. 14 is a sectional view along the line 14-14 in FIG. 10.
Figure 15:
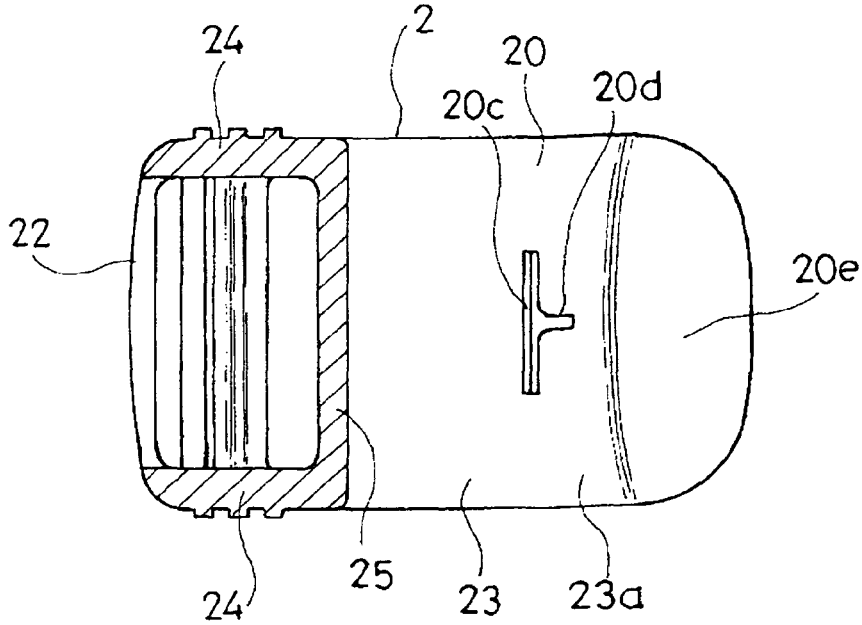
FIG. 15 is a sectional view along the line 15-15 in FIG. 12.
Figure 16:
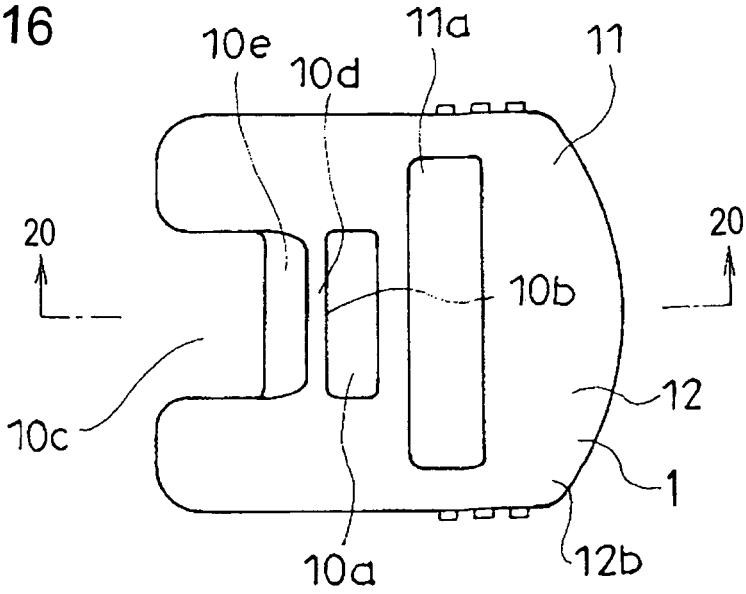
FIG. 16 is a front view of the male member 1.

Here, FIGS. 1 and 2 show the manner in which a belt-like body W is fastened by a buckle according to this invention, FIGS. 2 and 4 show the condition in which the male member 1 and the female member 2 constituting such buckle are separated, FIGS. 5-9 show a condition in which both male and female members 1, 2 are engaged, FIGS. 10-15 show said female member 2, and FIGS. 16-20 show said male member 1.

The buckle according to the invention comprises a male member 1 and a female member 2, the male and female members 1, 2 are caused to engage by having a part of the male member 1 engaged with the female member 2. For example, it is used for connecting belt-like bodies W, W attached to the male member 1 and the female member 2, respectively.

In this embodiment, the male member 1 has an insertion part 10 which serves as the part engaged with the female member 2, and an attaching part 11 to a belt-like body W or a cord-like body.

Figure 17:
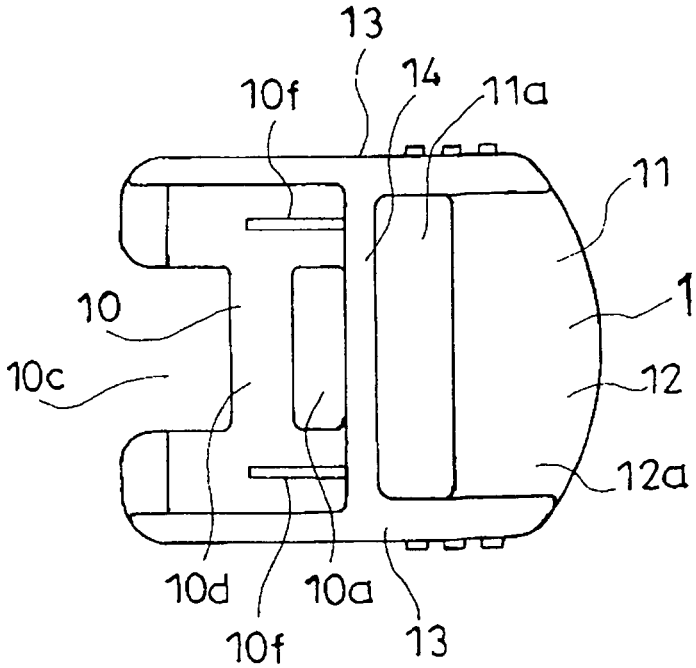
FIG. 17 is a back view of the same.
Figure 18:
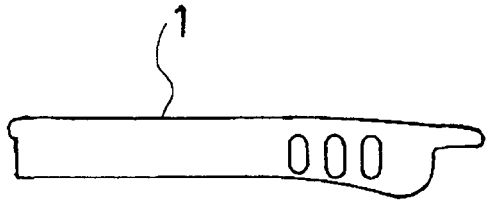
FIG. 18 is a side view of the same.
Figure 19:
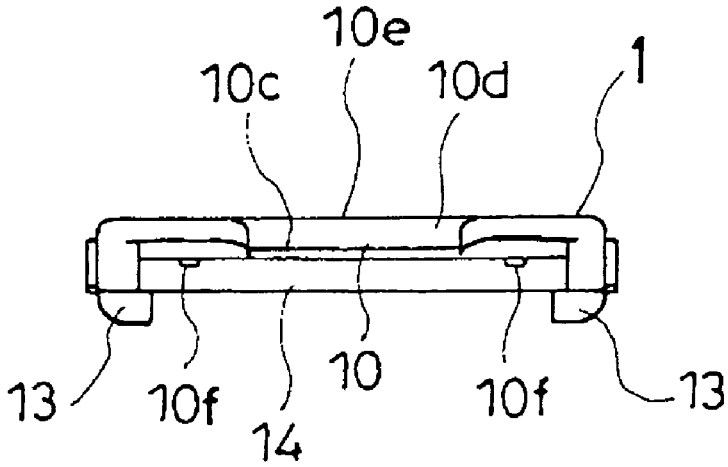
FIG. 19 is a side view of the same (view from the left side of FIG. 18).
Figure 20:
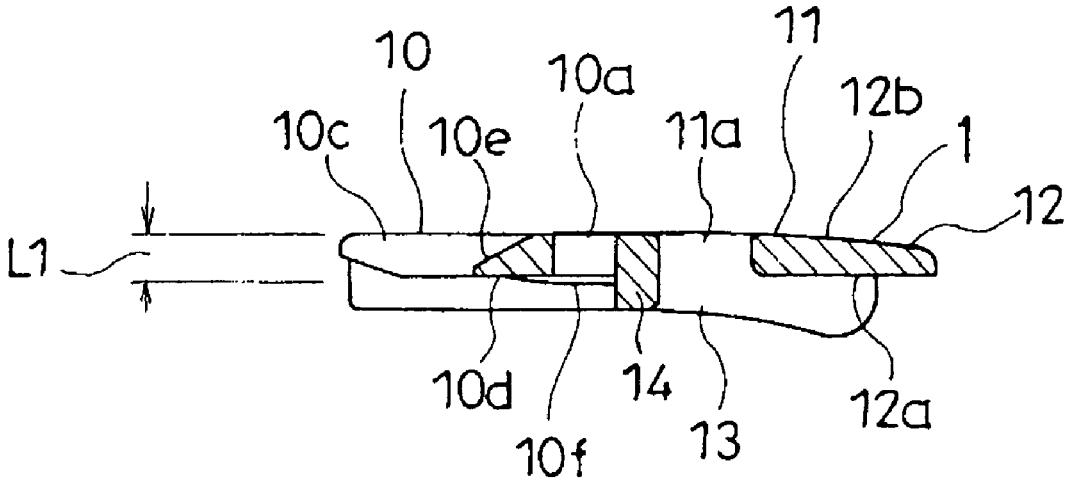
FIG. 20 is a sectional view along the line 20-20 in FIG. 16.

In the illustrated example, the male member 1 has rib-like parts 13 respectively formed on the back face 12*a* side of a plate-like base body 12, on a pair of edge parts following the direction of insertion x (FIGS. 3 and 4) into the female member 2 on this plate-like base body 12, and it has a dividing frame part 14 extending in a direction orthogonal to said direction of insertion x, being formed between the pair of rib-like parts 13, 13 in a position about halfway in the length direction of these rib-like parts. (FIG. 17)

In the illustrated example, a portion positioned on one side opposite to the female member 2 relative to the dividing frame part 14 on the plate-like base body 12, functions as said attaching part 11, and a portion positioned on the other side relative to the dividing frame part 14 functions as said insertion part 10.

On the attaching part 11, a slot 11*a* extending in the direction orthogonal to said direction of insertion x is formed in a manner so as to cross between said pair of rib-like parts 13, 13, and to have one edge part of the hole along the length direction of the slot 11*a* as said dividing frame part 14. In this example, a belt-like body W can be passed through the slot 11*a* to attach the male member 1 to this belt-like body W.

Also, on the insertion part 10, a slot 10*a* extending in the direction orthogonal to said direction of insertion x is formed in a manner so as to have equal spaces respectively between one end of this slot 10*a* and one of the pair of rib-like parts 13, 13, and the other end of this slot 10*a* and the other of the pair of rib-like parts 13, 13. The slot 10*a* of such insertion part 10 also is formed in a manner so as to have one edge part of the hole along its length direction as said dividing frame part 14. In this example, an engaging portion 20*c* to be described later of the female member 2 enters into the slot and is engaged at the position where the male member 1 is completely engaged with the female member 2, and the other edge part of the hole along the length direction of the slot 10*a* functions as a part engaged with 10*b*.

In the illustrated example, on the insertion part 10 of the male member 1, a cut-out part 10*c*, having a width about the same as the length of the slot 10*a* forming the corresponding engaging portion 10*b* and being opened on the leading end side of the insertion part 10 and extending toward the side of this slot 10*a*, is formed in a manner so as to form a bridge part 10*d* together with this slot 10*a*. On this bridge part 10*d*, on the front 12*b* side of the plate-like base body 12, there is formed an inclined part 10*e* which inclines gradually toward the direction of making this bridge part 10*d* thicker as it goes toward the corresponding engaging portion 10*b*.Also, during engagement of the part of the male member 1 into the female member 2, a second portion 21 of the female member 2 to be described later gradually bends as the engaging portion 20*c* of the female member 2 contacts with this inclined part 10*e*. Also, on such insertion part 10, on the back face 12*a* side of the plate-like base body 12, a raised line 10*f* along said direction of insertion x is formed between the two ends of the slot 10*a* forming the part coupled with 10*b* and the rib-like part 13, and the dimension L1 (FIG. 20) between this raised line 10*f* and the front face 12*b* side of the plate-like base body 12 becomes about equal to the interval L2 (FIG. 14) between a first portion 20 and a second portion 21 of the female member 2 to be described later.

Also, in the illustrated example, the width of the second portion 21 of the female member 2 to be described later becomes about equal to the dimension between the pair of rib-like parts 13, 13 of the insertion part 10 of the male member 1, and the insertion part 10 of the male member 1 is allowed to be inserted and engaged with the female member 2 only at the position where the second portion 21 is received with a little gap between the pair of rib-like parts 13, 13. That is, in this example, by the pair of rib-like parts 13, 13 and the second portion 21 of the female member 2, there is formed a guide part which is formed along the direction of engagement of the part of the male member 1, that is, said direction of insertion x, and guides the part of the male member 1 during the engagement.

The female member 2 has a first portion 20 and a second portion 21 and is configured so as to receive between them the part of the male member 1, that is, said insertion part 10, from its leading end side by bending of the second portion 21 from the leading end thereof.

In the illustrated example, the female member 2 has rib-like parts 24 on the back face 23*a* side of a plate-like base body 23, respectively on a pair of edge parts along the direction of insertion x of the male member 1 on the plate-like base body 23, formed along these edge parts in a range of about one third of the total length of these edge parts from the rear ends of these edge parts (the ends of the edge parts on the side opposite the side where the insertion part 10 of the male member 1 is inserted). In addition, it has a dividing frame part 25 extending in the direction orthogonal to said direction of insertion x, being formed between the front ends of the pair of rib-like parts 24, 24 thus provided.

In the illustrated example, the portion positioned on the side back from the dividing frame part 25 on the plate-like base body 23 functions as an attaching part 22 to a belt-like body W or a cord-like body, and the portion positioned in front from the dividing frame part 25 functions as said first portion 20.

On the attaching part 22, a first slot 22*a* extending in the direction orthogonal to said direction of insertion x is formed in a manner so as to cross between said pair of rib-like parts 24, 24, and to have one edge part of the hole along the length direction of the first slot 22*a* as said dividing frame part 25. Also, a second slot 22*b* extending in the direction orthogonal to-said direction of insertion x and crossing between said pair of rib-like parts 24, 24 is formed further back from this first slot 22*a*. In this example, a belt-like body W can be passed through the two slots 22*a*, 22*b* so as to loop the belt-like body W on a rod part 22*c* formed between such first slot 22*a* and second slot 22*b* to attach the female member 2 to this belt-like body W. (FIG. 2)

The second portion 21 is formed as a plate projecting forward having the rear edge part 21*a* integrally connected to the dividing frame part 25, and having the width between the left and right edge parts 21*b*, 21*b* made about equal to the interval between the pair of rib-like parts 24, 24 of the insertion part 10 of the male member 1. The front edge part 20*a* serving as the leading end of the side of the first portion 20 is positioned further in front from the front edge part 21*c* serving as the leading end of the side of the second portion 21. (FIG. 11) An interval L2 about equal to the dimension L1 between said raised line 10*f* of the insertion part 10 of said male member 1 and the side of the front face 12*b* of the plate-like base part 12 is formed between the inner face 21*d* of this second portion 21 and the inner face 20*b* of the first portion 20, that is, the back face 23*a* of said plate-like base body 23. In the illustrated example, it is made such that the insertion part 10 of the male member 1 is allowed to be inserted and received between the first portion 20 and the second portion 21 of the female member 2 up to a position where the leading end of the insertion part 10 of the male member 1 bumps into the dividing frame part 25 of the female member 2 and the front edge part 21*c* of the second portion 21 of the female member 2 bumps into the dividing frame part 14 of the male member 1.

Also, in the embodiment, on the female member 2, there is formed on the first portion 20 an engaging portion 20*c* which is engaged with a corresponding engaging portion 10*b* formed on the male member 1 by bending back of the second portion 21 at the final position of the engagement. In the illustrated example, the engaging portion 20*c* is constituted as a rib-like projection which projects out from the inner face 20*b* of the first portion 20 toward the inner face 21*d* of the leading end of the side of the second portion 21 and extends in the direction orthogonal to the direction of insertion x of the insertion part 10 of the male member 1. The length of the engaging portion 20*c* is somewhat smaller than the length of the slot 10*a* of the insertion part 10 of the male member 1, also, the interval L3 (FIG. 14) between the leading end of this engaging portion 20*c* and the inner face 21 of the second portion 21 is smaller than the greatest thickness of the bridge part 10*d* of the insertion part 10 of the male member 1. In the illustrated example, on the front side of the engaging portion 20*c*, an inclined part is formed also on the side of the female member 2, by the inclined side of a triangular plate-like body 20*d* having the inclined side facing forward, being integrally provided with the engaging portion 20*c* in a position about halfway in its length direction.

Also, in this embodiment, the first portion 20 of the female member 2 comprises a part of said plate-like base body 23 so as not to cause elastic deformation, while the second portion 21 is thinner than the first portion 20 so as to cause elastic deformation centered on the its side base parts 21*f*. In the illustrated example, in particular, on the second portion 21, there is formed a roughly square hole portion 21*e* which is provided in a manner such that one side of the hole is made to extend along the dividing frame part 25, and two sides surrounding this hole portion 21*e* serve as the side base parts 21*f* of the second portion 21, and they make said bending of the second portion 21 easier.

The engagement of the insertion part 10 as the part of the male member 1 between the first portion 20 and the second portion 21 of the female member 2 is allowed by the bending of the second portion 21, and the female member 2 and the male member 1 are connected by the engagement of the engaging portion 20*c* with the corresponding engaging portion 10*b* by the bending at the final position of this engagement. Because said engagement is allowed by the bending of the second portion 21, and the engaging portion 20*c* is provided on the first portion 20 which does not bend, even when the second portion 21 is easy to bend so as to reduce the force of insertion necessary for said engagement, the state of connection of the male and female members 1, 2 is secure and stable regardless of the presence or absence of action of a force in the direction of pulling the male member 1 out from the female member 2 (pulling-out force).

From this state of connection, when the first portion 20 is operated toward the direction of separating it from the part of the received male member 1, concretely, when force is applied to the leading end of the side of the first portion 20 toward the direction of separating the leading end of the side from the part of the male member 1, because the first portion 20 does not bend as mentioned previously, the second portion 21 is caused to be bent toward the direction of moving away from the first portion 20 via the male member 1, whereby the space between the first portion 20 and the second portion 21 is widened in the same manner as during said engagement of the part of the male member 1 and the engagement of the engaging portion 20*c* and the corresponding engaging portion 10*b* can be released. By this, the connection of the male and female members 1, 2 can be released. That is, in the buckle according to the embodiment, the second portion 21 is easy to bend so that connection of the male member 1 and the female member 2 is easy to do, while the state of connection can be made as secure as possible. Also, the buckle can have a nice cosmetic appearance with the first portion 20 as the front side of the buckle, also, an area for display of logos, and the like, can be sufficiently secured on the front side of the buckle.

Also, in this embodiment, on the first portion 20 of the female member 2, there is provided an operating part 20*e* which makes it possible to separate this first portion 20 from the part of the received male member 1 while causing the second portion 21 to bend. In the illustrated example, the space from somewhat forward of the engaging portion 20*c* of the female member 2 to the leading end of the side serves as the operating part 20*e* which inclines toward the direction of gradually moving away from a virtual plane including the inner face of the second portion 21 as it goes toward the leading end of the side, and between the inner face of the operating part 20*e* and the front face 12*b* of the plate-like base body 12 of the male member 1, a gap y for applying a finger, or the like, is formed in the state of connection of the male and female members 1, 2. (FIG. 2) By this, in this example, the operation of said first portion 20 in order to release the connection of the male and female members 1, 2 is made easier to perform.

Also, in this embodiment, when said belt-like body W or cord-like body attached to the attaching part as mentioned previously is tensed, the engaging portion 20*c* is positioned on the active central axis z of the load applied to these. (FIG. 2) By this, the engaging portion 20*c* can be engaged even more securely with the corresponding engaging portion 10*b* during such tension.

Furthermore, provision of the characteristic of elastic deformation to the area on the female member 2 where it should be provided as explained above can be assured easily and appropriately by forming the female member 2 with plastic material.

The disclosure of Japanese Patent Application No. 2008-139428 filed on May 28, 2008 is incorporated as a reference.

While the invention has been explained with reference to the specific embodiments of the invention, the explanation is illustrative and the invention is limited only by the appended claims.

What is claimed is:

1. A buckle, comprising:

a male member;

a female member for engaging the male member, having a frame part, a first portion extending laterally from the frame part and a second portion extending laterally from the frame part under the first portion to be spaced therefrom without connecting thereto, said second portion being configured to bend so as to receive a part of the male member between the first and second portions;

a first engaging portion provided on the first portion facing the second portion;

a second engaging portion provided on the male member for engaging the first engaging portion, said second portion being configured to press the male member toward the first portion to engage the first engaging portion with the second engaging portion when the male member is inserted between the first and second portion; and an operating portion provided on the first portion for separating the first portion from the male member and causing the second portion to bend.

* * * * *